US006978557B2

(12) United States Patent
Lee

(10) Patent No.: US 6,978,557 B2
(45) Date of Patent: Dec. 27, 2005

(54) METHOD FOR MANUFACTURING SHOES AND SHOES MANUFACTURED BY THE METHOD

(75) Inventor: Yong Koo Lee, Hyundai Mansion No. 401, 1025-2, Bangbae-Dong, Seocho-Gu, Seoul 137-061 (KR)

(73) Assignee: Yong Koo Lee, Seoul (KR)

( * ) Notice: Subject to any disclaimer, the term of this patent is extended or adjusted under 35 U.S.C. 154(b) by 22 days.

(21) Appl. No.: 10/406,714

(22) Filed: Apr. 2, 2003

(65) Prior Publication Data

US 2004/0117925 A1 Jun. 24, 2004

(30) Foreign Application Priority Data

Dec. 18, 2002 (KR) ..... 10-2002-0081166

(51) Int. Cl.[7] ..... A43B 13/32

(52) U.S. Cl. ..... 36/19.5; 36/4; 12/142 F; 12/142 T

(58) Field of Search ..... 36/19.5, 18, 19 R, 36/4; 12/142 B, 142 C, 142 E, 142 F, 142 RS, 12/142 T

(56) References Cited

U.S. PATENT DOCUMENTS

| | | | | |
|---|---|---|---|---|
| 4,276,671 A * | 7/1981 | Melton | ..... | 12/142 T |
| 4,651,444 A * | 3/1987 | Ours | ..... | 12/142 T |
| 5,203,792 A * | 4/1993 | Kaiser | ..... | 12/142 C |
| 6,115,940 A * | 9/2000 | Chen | ..... | 36/55 |
| RE37,705 E * | 5/2002 | Donzis | ..... | 12/142 R |
| 6,446,360 B1 * | 9/2002 | Sheets et al. | ..... | 36/55 |
| 6,662,469 B2 * | 12/2003 | Belley et al. | ..... | 12/142 T |
| 6,698,108 B2 * | 3/2004 | Pavelescu et al. | ..... | 36/55 |

* cited by examiner

*Primary Examiner*—Anthony Stashick
(74) *Attorney, Agent, or Firm*—Anderson Kill & Olick PC; Eugene Lieberstein; Michael N. Meller

(57) ABSTRACT

A method for manufacturing shoes is provided. The method includes preparing an upper and an outsole, applying an adhesive agent to the outer surface of an upper seal portion and the inner surface of an outsole seal portion, stitching together the outer surface of the upper seal portion and inner surface of the outsole seal portion, activating the adhesive agent by applying heat to the stitched seal portions, and molding the upper and the outsole by using a molding machine. Therefore, since the amount of the upper can be reduced and a separate insole is not necessary, the total weight of the shoes can also be reduced. The flexibility of shoes can also be enhanced.

3 Claims, 3 Drawing Sheets

METHOD FOR MANUFACTURING SHOES AND SHOES MANUFACTURED BY THE METHOD

BACKGROUND OF THE INVENTION

1. Field of the Invention

The present invention relates to a method for manufacturing shoes and shoes manufactured by the method. More particularly, the invention relates to a method for manufacturing shoes which can reduce the manufacturing cost and total weight of shoes by reducing amounts of leather and an upper required for manufacturing the shoes, and can enhance flexibility of the shoes, and to shoes manufactured by the method.

2. Description of the Related Art

FIG. 3 is a side view of an upper for a shoe manufactured by a conventional shoe manufacturing method of an adhesive type, and FIG. 4 is a schematic sectional side view of a shoe manufactured by the method.

In the conventional method, the shoe is manufactured into a predetermined shape by cutting an upper 30 with a sufficient margin, and the upper is based on natural leather, artificial leather or synthetic material. Then, an insole 50 is arranged inside of the upper 30 along the line C shown in FIG. 3, and an adhesive agent is applied to the internal surface of a bottom portion 34 of the upper 30. Thereafter, the bottom portion 34 of the upper 30 is folded inward so as to wrap the insole 50 to then be sealed to the insole 50. Actually, the bottom portion 34 is suitably cut or ground to make the folded plane evenly trimmed without irregularities, followed by sealing. Here, a considerably large part of the bottom portion 34 of the upper 30 should be folded so as to tightly seal with the insole 50. The line C shown in FIG. 3 is a folded line, and reference symbol CH denotes a folded length of the upper 30.

In such a manner, the upper 30 is integrally formed with the insole 50 to make the bottom of the shoe closed, as shown in FIG. 4. Then, the bottom surface and lower outer surface formed by sealing the upper 30 and the insole 50 are compressed and sealed to the top surface and inner surface of the outsole 60, respectively, thereby completing the manufacture. Thereafter, for the purpose of increasing a user's comfort, a separate soft foot-sole (not shown) may be mounted on the insole 50. Undefined reference numeral 40 denotes a last, which is used in the compression and sealing step. The last 40 is used to fix the upper 30 and to compress the insole 50 to the outsole 60 in the manufacture of shoes. However, in the conventional method, unnecessary consumption of an upper is involved in adhesion step of the upper, resulting in an increase in manufacturing cost. Also, in the conventional method, several steps including cutting an upper, folding and gluing the upper 30 toward the insole 50 are necessary in forming an adhesion plane between the outsole and the insole, consuming a considerable manufacturing time. In addition, the conventional adhesive type requires much adhesive materials and adhering tools, increasing a work force.

Although not shown, a stitch type shoe manufacturing method in which the bottom portion of the upper 30 is simply stitched with the outsole 60, rather than wrapping the insole 50 to be sealed, is also known. According to this method, however, structural weakness is involved, lowering durability of shoes. Thus, this method cannot be applied to ordinary shoes or sport shoes, but are restrictively applied to cheap, short-term shoes or disposable shoes. Also, when used in the rain or at a ski resort, even well stitched shoes are vulnerable to infiltration of water due to poor waterproofness.

SUMMARY OF THE INVENTION

To solve the above-described problems, it is an object of the present invention to provide a shoe manufacturing method, which can reduce an amount of an upper and a time required in manufacturing shoes, can reduce the total weight of the shoes, and can enhance flexibility of the shoes. Also, the present invention provides shoes manufactured by the manufacturing method. Further, the present invention provides shoes having high durability and good waterproofness by performing an adhering step, preceded by a stitching step.

In accordance with an aspect of the present invention, there is provided a method including preparing an upper and an outsole, applying an adhesive agent to the outer surface of a seal portion of the upper and the inner surface of an outsole seal portion, stitching together the outer surface of the upper seal portion and inner surface of the outsole seal portion, activating the adhesive agent by applying heat to the stitched seal portions, and molding the upper and the outsole by using a compression molding machine.

In accordance with another aspect of the present invention, there is provided shoes manufactured by the method.

BRIEF DESCRIPTION OF THE DRAWINGS

The above objects and advantages of the present invention will become more apparent by describing in detail preferred embodiments thereof with reference to the attached drawings in which.

DETAILED DESCRIPTION OF THE INVENTION

The present invention will now be described in detail with reference to the accompanying drawing.

Figure 1:
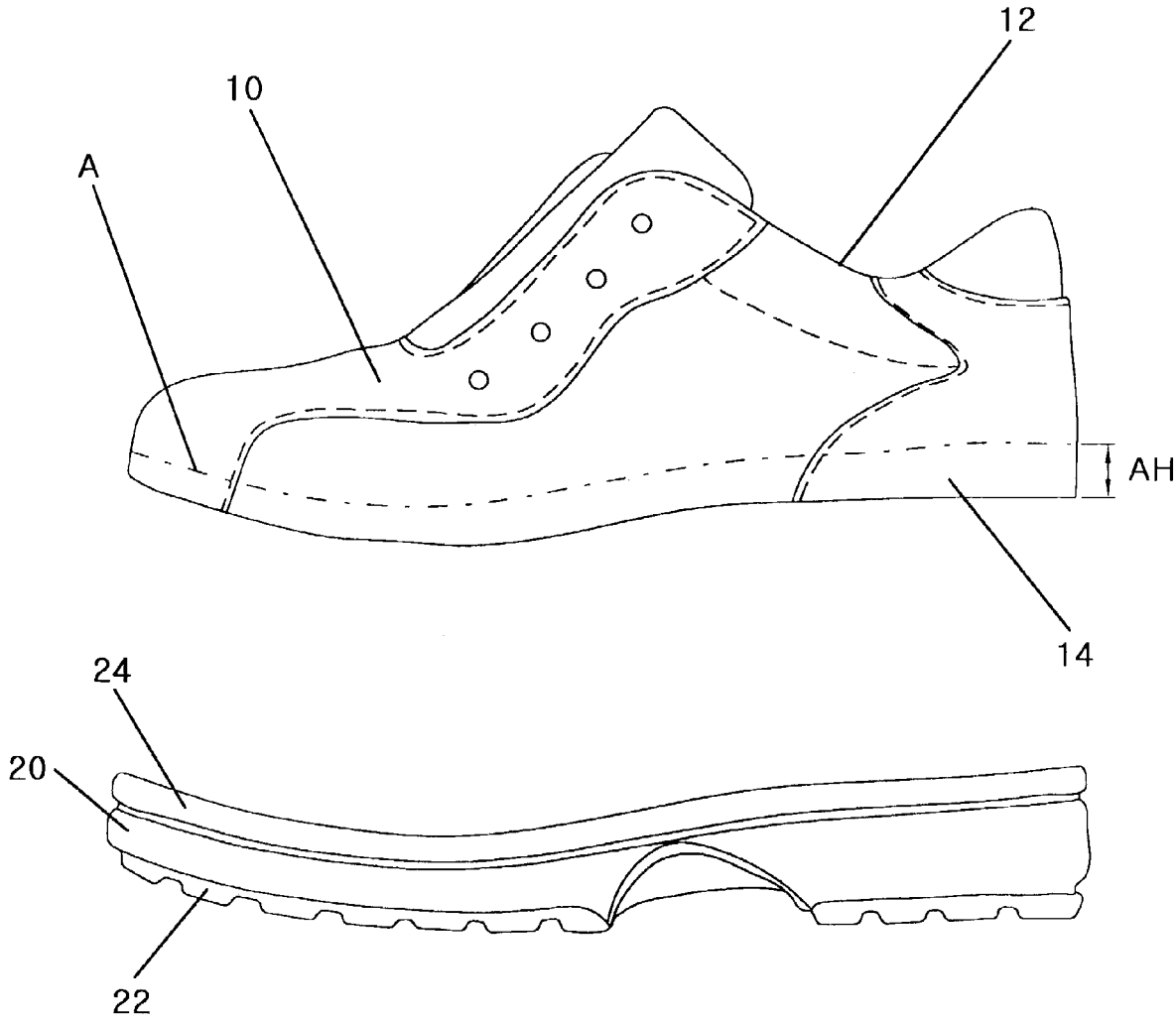
FIG. 1 is a schematic exploded side view of a shoe according to the present invention.
Figure 2:
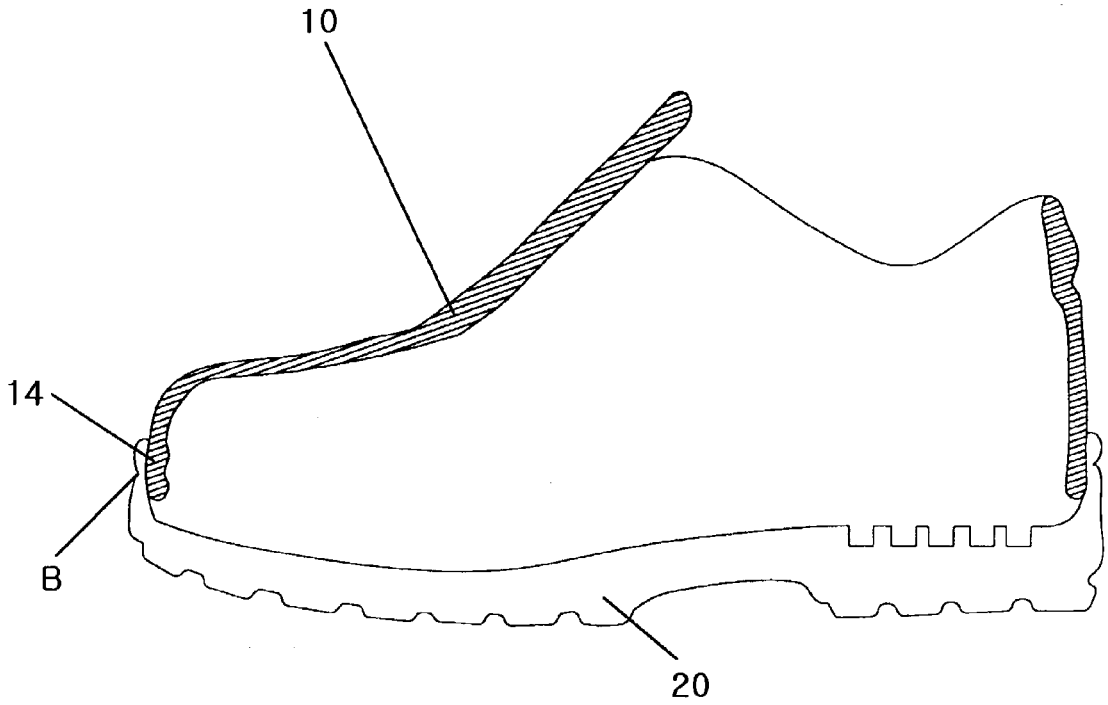
FIG. 2 is a schematic sectional side view of a shoe according to the present invention.

FIG. 1 is a schematic separated side view of a shoe according to the present invention, and FIG. 2 is a schematic sectional side view of a shoe according to the present invention. Referring thereto, the shoe according to the present invention largely includes an upper 10 and an outsole 20. Also, the shoe according to the present invention further includes at least one foot-sole (not shown) that can be put on the outsole 20 inside the shoe.

The upper 10 is formed in conformity with the shape of a foot. An opening 12 for insertion of a foot is formed at the upper portion of the upper 10, and an upper seal portion 14 is formed at the lower portion of the upper 10 to be glued and stitched to the outsole 20. An outsole 20 includes a lower portion 22 suitable for the purposes, and an outsole seal portion 24 formed at the upper portion of the outsole 20 has a certain height.

The method of manufacturing shoes according to the present invention will be described referring to FIGS. 1 and 2. First, the upper 10 and the outsole 20 are prepared. The upper seal portion 14 formed at the lower portion of the upper 10 corresponds to the shape of the outsole seal portion 24 formed at the upper portion of the outsole 20. In order to facilitate the sealing step, the upper seal portion 14 is preferably thinned and subjected to surface treatment.

Next, an adhesive agent is applied to outer surface of the upper seal portion 14 and inner surface of the outsole seal portion 24. The outer surface of the upper seal portion 14 and the inner surface of the outsole seal portion 24 are stitched together. Then, the adhesive agent is activated by applying heat to the stitched seal portions. After the activation, the upper 10 and the outsole 20 are integrally molded by using a compression molding machine, followed by trimming, thereby completing the manufacture. Since the upper 10 is sealed directly after being stitched to the outsole 20 without folding, consumption of relatively expensive upper 10 and the adhesive agent can be reduced, while ensuring durability and waterproof. Also, since sealing is possible without using a conventional insole, unlike in the conventional method, the manufacturing process can be simplified and lightweight shoes can be manufactured. Further, flexibility of shoes can be enhanced.

Figure 3:
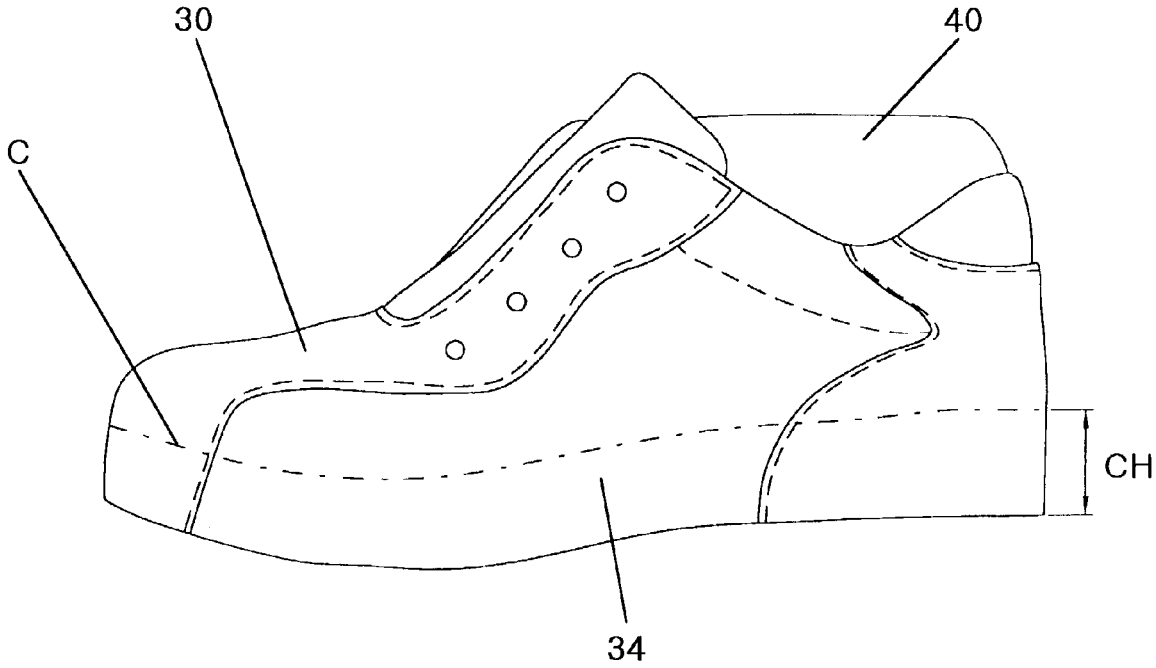
Prior Art FIG. 3
FIG. 3 is a side view of an upper for a shoe according to a conventional adhesive type shoe manufacturing method.

In FIG. 1, the upper 10 shown under the line A, corresponds to the upper seal portion 14 to which the internal surface of the outsole seal portion 24 is adhered. In the manufacture of shoes, the adhesive agent is actually applied to the upper seal portion 14. Comparing the upper of the present invention with that of the conventional shoe manufacturing method shown in FIG. 3, the amount of the upper, corresponding to a difference in height between CH in FIG. 3 and AH in FIG. 1 can be reduced. In other words, in the conventional adhesive type shoe manufacturing method, the folded height of the upper 30 is approximately 15 mm. The folded height of the upper seal portion 14 of the shoes according to the present invention is approximately 10 mm. Thus, the amount of the upper of approximately 5 mm can be reduced. The sealing of the upper 10 and the outsole 20 can be further strengthened by stitching and gluing. Reference symbol B denotes the stitched portion.

Figure 4:
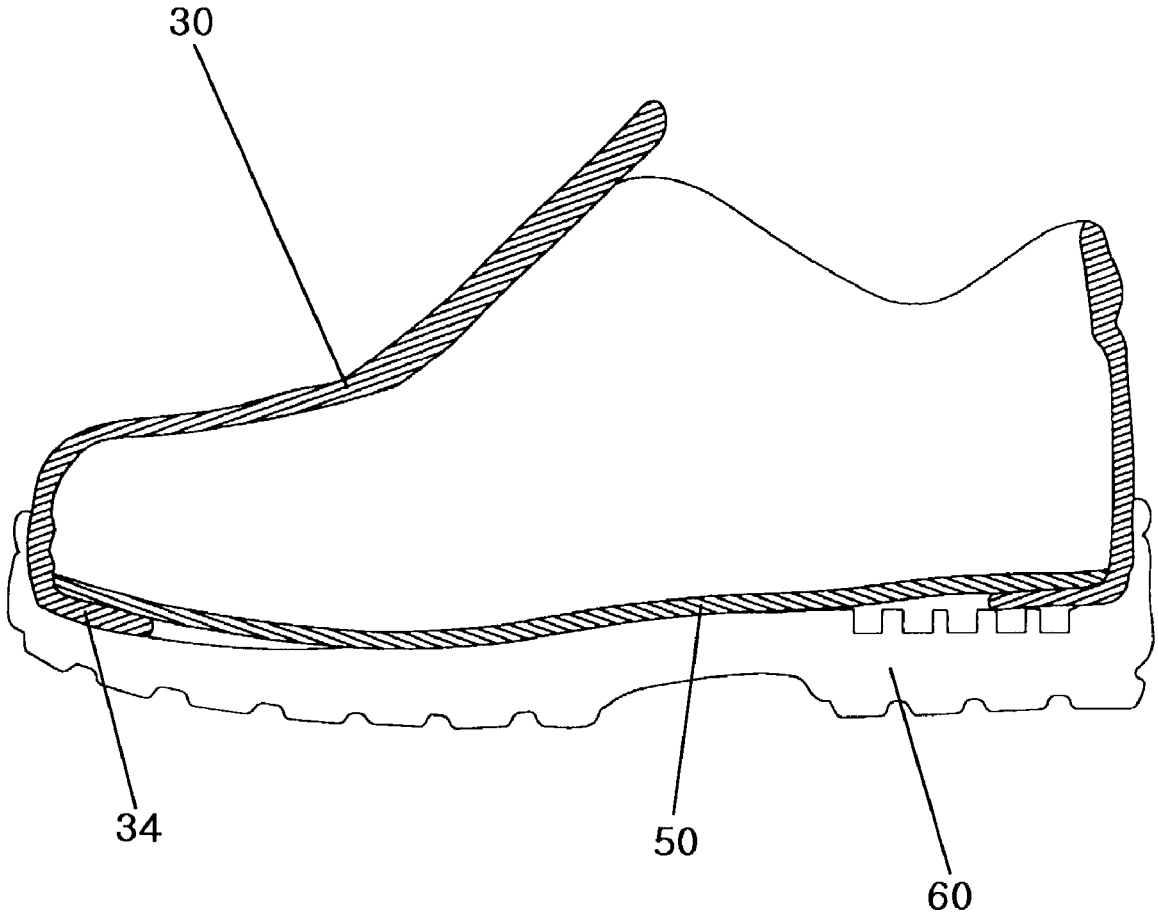
Prior Art FIG. 4
FIG. 4 is a schematic sectional side view of a shoe according to the conventional adhesive type shoe manufacturing method.

At least one foot-sole made of resilient or soft material is preferably inserted to enhance comfort. Referring to FIG. 2, protrusions and depressions are formed at the heal portion of the outsole 20 for the purpose of reducing the weight and raw materials of the shoes, which is also applied to the conventional case shown in FIG. 4.

According to the shoe manufacturing method according to the present invention and shoes manufactured using the method, the amount of a relatively expensive upper can be reduced, thereby reducing the manufacturing cost. Since it is not necessary to employ an insole for fixing the upper and forming a seal surface, the manufacturing procedure and time can also be reduced. Further, since the amount of the upper can be reduced and the conventional insole is not necessary, the total weight of the shoes can also be reduced. The flexibility of shoes can also be enhanced. Also, since an adhesion step is performed together with stitching step, durability and waterproof of the shoe can be greatly improved.

While this invention has been particularly shown and described with reference to preferred embodiments thereof, it will be understood by those skilled in the art that various changes in form and details may be made therein without departing from the spirit and scope of the invention as defined by the appended claims.

What is claimed is:

1. A method for manufacturing casual shoes comprising the steps of:

preparing an upper and an outsole, the upper having an upper portion conforming to the shape of a foot, a lower portion and an upper seal portion formed at its lower portion with the outsole having a lower bottom portion and an outsole seal portion extending a predetermined height above the lower bottom portion such that said outsole seal portion forms an upstanding self supporting peripheral rim;

applying an adhesive agent to an outer surface of the upper seal portion formed at the lower portion of the upper and to an inner surface of the upstanding self supporting peripheral rim of the outsole seal portion;

inserting the lower portion of the upper into the outsole seal portion of the outsole such that said upper seal portion faces and overlaps the upstanding self supporting peripheral rim of the outsole seal portion without any folding over of the lower portion of the upper on the lower bottom portion of said outsole;

stitching the upper seal portion of the upper to the upstanding self supporting peripheral rim of said outsole along said overlap with said applied adhesive disposed therebetween so as to seal the outsole to the upper without incorporating an insole in the sealing operation;

mounting a conventional insole upon the lower bottom portion of the outsole for structural support and comfort;

activating the adhesive agent by applying heat to the stitched seal portion; and molding the upper and the outsole using a compression molding machine.

2. Shoes manufactured by the method claimed in claim 1 wherein said predetermined height of said outsole seal portion above the lower bottom portion is no larger than about 10 mm.

3. A casual shoe comprising an upper and an outsole with the upper having an upper portion conforming to the shape of a foot and a lower portion and with the outsole having a lower bottom portion and an outsole seal portion extending upright a predetermined height above the lower bottom portion to form an upstanding self supporting peripheral rim disposed in overlapping contiguous engagement with the lower portion of the upper without intervening member(s) and without any folding over of the lower portion of the upper on the lower bottom portion of said outsole and wherein the self supporting peripheral rim of the outsole and the lower portion of the upper is in sealed engagement to one another through a seal consisting solely of stitching and an adhesive agent and including an insole mounted upon the lower bottom portion of the outsole for providing structural support and comfort to the shoe.

* * * * *